US005384961A

United States Patent [19]

Gregory

[11] Patent Number: 5,384,961

[45] Date of Patent: Jan. 31, 1995

[54] APPARATUS FOR SHAVING

[76] Inventor: Harbert S. Gregory, 26 Country Club Park, Covington, La. 70433

[21] Appl. No.: 75,376

[22] Filed: Jun. 14, 1993

Related U.S. Application Data

[63] Continuation-in-part of Ser. No. 874,963, Apr. 27, 1992, abandoned.

[51] Int. Cl.[6] ..... B26B 21/44

[52] U.S. Cl. ..... 30/41.5; 30/41

[58] Field of Search ..... 30/41, 41.5, 32, 47, 30/79

[56] References Cited

U.S. PATENT DOCUMENTS

| | | | |
|---|---|---|---|
| 4,238,882 | 12/1980 | Harrison | 30/41 |
| 4,247,982 | 2/1981 | Booth et al. | 30/41 |
| 4,395,822 | 8/1983 | Ciaffone | 30/41 |
| 4,850,107 | 7/1989 | Valriades et al. | 30/41 |
| 4,984,364 | 1/1991 | Simmons | 30/41 |
| 5,072,512 | 12/1991 | Noujain | 30/41.5 |
| 5,134,775 | 8/1992 | Althaus et al. | 30/41.5 |

FOREIGN PATENT DOCUMENTS

| | | | |
|---|---|---|---|
| 2183523 | 6/1987 | United Kingdom | 30/41 |

*Primary Examiner*—Richard K. Seidel

*Attorney, Agent, or Firm*—Veal & Marsh

[57] ABSTRACT

An apparatus for shaving that contains a rectangular dispenser detachably connected between a razor handle and a disposable blade carrying head. The dispenser includes a reservoir that may be divided into open compartments that are in direct communication with separate conduits in the blade head that extend adjacent to the blades carried by the disposable head. Once installed, placing the apparatus's beneath a running faucet fills the reservoir and the internal baffling structure retains the water in the apparatus until contact with the user's face. The user applies a water soluble lubricant to the face and allows the lubricant to dry into a film. Shaving foam may also be applied to the face over the dry lubricant. When the blades are placed against the user's face, the water flows from the reservoir onto the blades and the user's face adjacent thereto to reactivate the lubricant just prior to the passage of the blades thereover.

12 Claims, 3 Drawing Sheets

FIG. 6
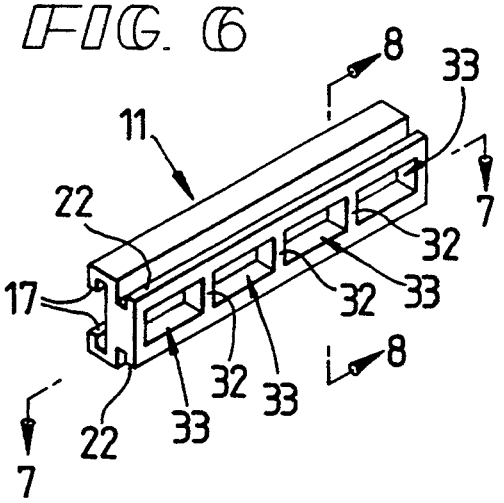
FIG. 7
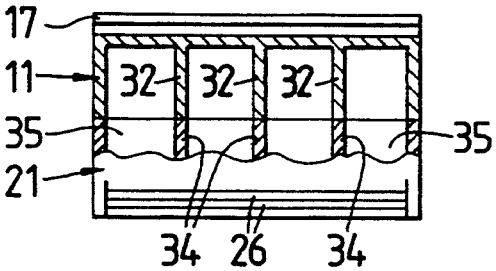
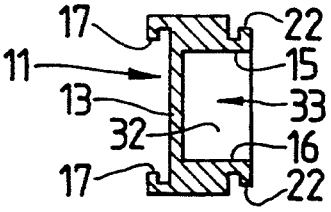
FIG. 8
FIG. 9
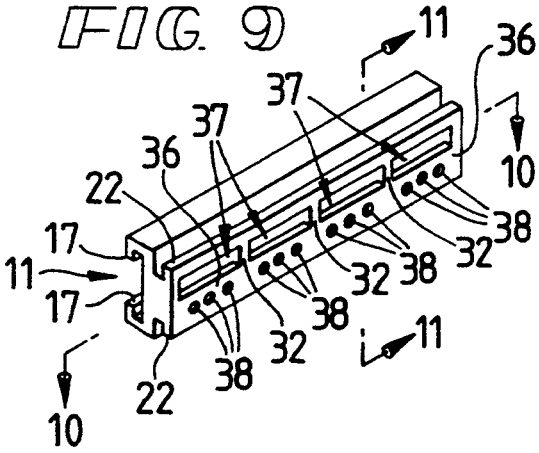
FIG. 10
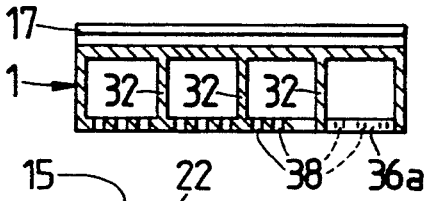
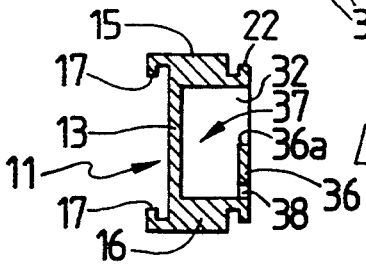
FIG. 11
FIG. 12
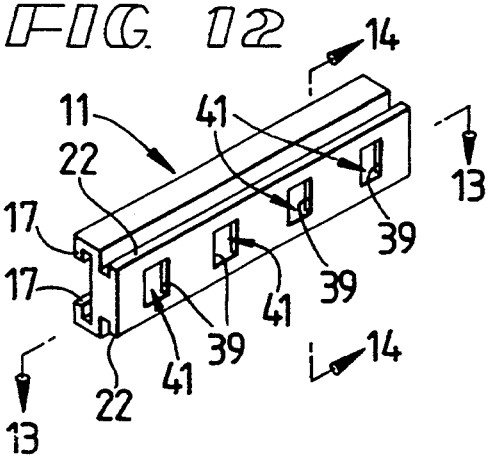
FIG. 13
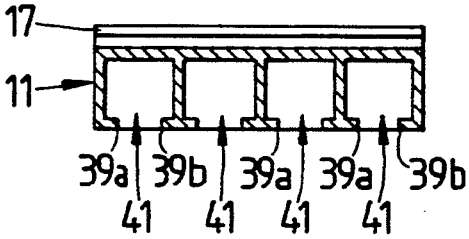
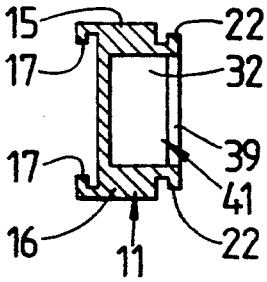
FIG. 14

APPARATUS FOR SHAVING

This is a continuation-in-part of application Ser. No. 07/874,963, filed Apr. 27, 1992, now abandoned.

FIELD OF THE INVENTION

The present invention relates to shaving implements and particularly to disposable razors having a blade carrying head detachably and reattachably connected to a handle. In greater particularity, the present invention relates to razors having a fluid reservoir thereon for dispensing water onto one or more razor blades carried by the razor. In even greater particularity, the present invention relates to instant interaction of automatically controlled dispensed water on a film of dried lubricant pre-applied to a user's face to minimize the abrading thereof by a razor.

BACKGROUND OF THE INVENTION

Shaving comfort is defined as smoothness of the shaving stroke. The ultimate objective is to gain the closest possible shave, without abrading the skin. Several factors must be considered to provide maximum closeness, smoothness and comfort. The most crucial factors are: (1) softness of facial hairs; (2) keenness of the razor blades; (3) facial hair orientation relative to the skin surface and razor blades; and (4) maximum lubrication to remove friction between the moving razor head and skin, and to render the skin surface so slippery that abrasion by the moving blade is eliminated.

The cutting edge of the razor blades must be very keen to provide the most efficient cutting of facial hair. Closely associated with razor keenness is facial hair orientation relative to skin surface. Facial hair should be standing as normal as possible to the user's face and razor blades such that a minimum cross-section is presented to the blade. In other words, the hair should protrude substantially perpendicular to or at a substantially ninety degree angle relative to the skin surface. Such hair orientation affords enhanced comfort and cutting efficiency due to less surface area of hair to be cut. The most successful and widely used method employed to hold facial hair erect is through the use of shaving foam or gel. Note, however, that shaving foam has many other purposes in addition to facial hair orientation (e.g., medicated, scented, moisturizers), namely softening of facial hair.

An additional factor involved with the efficient cutting of facial hair is the temperature of the water on the skin surface. The warmer the water on the user's face, the softer the facial hair becomes which complements the function of the present invention.

Natural friction between the moving razor head and skin surface must be minimized to avoid locally distorting the skin thus leaning the hair away as the blade approaches. Maximum lubrication of the skin must be present to minimize the friction, and to lubricate the skin so that the blade edge will "slide" instead of "cut" the skin. When the friction is reduced, and maximum lubrication is provided, nicks and razor abrasion are also reduced which promotes shaving comfort. The degree of lubrication depends on the amount of lubricant which is activated in place when the blade moves across the skin. Diluted lubricant does not prevent razor burn.

Various usages of razors, especially disposable razors, shaving foams, water and selected lubricants for facilitating the removal of facial hair from the surface of a user's face, are commonly known. Most commonly, a user will wet his face and apply shaving foam, cream or gel thereto before stroking the razor blades across the face. On application, the foam must be quite dry, or it will not hold its position on the face. The water, which is retained in the dampness of the face and which clings to the razor body, interacts with the shaving foam to soften the user's facial hairs and to hold them erect thus promoting easier cutting thereof by the razor blades. Dilute lubricants may be embodied in the foam to interact with the water and lubricate the user's face to effect unabrasive movement of the razor blades thereacross.

However, the major problem with using shaving foams having lubricants therein is that the amount of lubricant and water retained on the user's face is minimal. Water has a tendency to: (1) combine with the foam; (2) evaporate; and (3) run-off due to gravitation, thus negating its lubricating effectiveness. Hence, lubrication of the skin must be maximized and remain constant to avoid nicks and abrasion, therefore water must remain constant or be constantly applied.

A diluted pre-shave "water-based" lubricant (i.e., a lubricant that contains water) which depends on facial wetness loses much of its desired lubricating effectiveness when shaving foam is applied thereon and combined therewith. The comparatively dry foam, when applied to the pre-shave water-based lubricant, wicks the wet lubricant from the user's face making the face highly vulnerable to skin abrasion. The diluted lubricant will provide reduced lubrication.

A more successful attempt to maintain the lubricant and shaving foam in a hydrated form was the development of water and/or lubricant dispersing razors which supply a quantity of water or lubricant to the user's face adjacent to the blades. Exemplary of such razors is that shown in U.S. Pat. No. 2,120,940, issued to Minassian, which includes a reservoir superjacent the blades whereby water seeps from the reservoir and onto the blades. Another example of such razors is U.S. Pat. No. 4,809,432, issued to Schauble. Schauble includes a hollow handle having emollient stored therein and discharged therefrom adjacent the blades. A similar razor is disclosed in U.S. Pat. No. 2,747,273, issued to Olsson, which has a fluid containing reservoir in the handle and means for dispersing the fluid therefrom and onto a razor blade. Lastly, U.S. Pat. No. 4,238,882, issued to Harrison, Sr., discloses a razor having a shaving-liquid reservoir.

Harrison's reservoir includes a filling tube which opens to the atmosphere proximal the razor's handle. It is sealed once the reservoir is full of shaving liquid. In addition, a "very small breather duct" extends through the wall of the reservoir into the atmosphere to let air escape while the reservoir is being filled. The breather duct is so small that the surface tension of the shaving liquid will not permit the liquid to pass through the duct. No amount of movement, rotation or shaking of the reservoir will overcome the surface tension thus allowing shaving liquid to escape through the breather duct. Only air can pass through the breather duct.

In addition to the breather duct, capillary size ports extend through the top of Harrison's reservoir. These can also be characterized as weep holes. A double-edge razor blade is captured by a cap intermediate the cap and the outer surface of the top of the reservoir. The blade is captured so that it overlies the capillary size ports in the top of the reservoir.

Once the reservoir is filled, the shaving liquid tends to fill the capillary size ports. Some of the shaving liquid passes through the capillary size ports and migrates into the interstices between the adjacent surfaces of the razor blade and outer surface of the top of the reservoir. As a result, Harrison discloses that a vacuum tends to build up in the reservoir as some of the liquid is fed through the capillary size ports so that an equilibrium is quickly reached tending to oppose further feed of the liquid through the capillary size ports.

However, the system is designed so that as soon as the person begins shaving, the razor blade will begin a small fluttering action between the cap and the top of the reservoir, whereby a small amount of shaving liquid will be pumped out of the reservoir, through the capillary size ports, past the interstices mentioned earlier, to the skin of the user. Thus, in order for Harrison's invention to be operable, Harrison requires a pumping action due to the fluttering of the razor blade in order to dispense liquid from his reservoir.

Nevertheless, the common characteristic of the prior art devices discussed heretofore is that the handle and razor engaging heads are affixed, with only the razor blade itself being a disposable component. Since the head is affixed to the handle, the head can be channeled, hollowed or otherwise constructed to conduct fluid to the blades.

The more commonly used razors on the market today use a blade carrying head that is disposable along with the razor blades carried thereby. The prior art cited above could not accommodate such disposable heads. Further, such razors having hollowed handles and/or heads plus additional means for facilitating flow are comparatively more complex than most disposable razors thus significantly more difficult to manufacture and accordingly more expensive to purchase. Also, the razors described above, though allegedly efficient in providing water to the user's face, do not address the problem of the wicking of separately applied lubricant from the user's face by the shaving cream applied thereto. Further, prior razors do not offer volume selectivity to accommodate variations in the heaviness of the user's beard which may require more or less water to perform the entire stroke. Also, the prior razors do not provide any control feature that enables the user to elect when, during the course of a stroke, the water will be released to activate the lubricant. The other systems also do not provide a means where by the water can be maintained with desired temperature as does this system which involves frequent refills.

SUMMARY OF THE INVENTION

It is the principal object of the present invention to provide an attachment for disposable razors having a blade carrying head detachably and reattachably connected to a handle, wherein the attachment supplies a controlled quantity of water to the blades and user's face adjacent thereto.

Another object of the present invention is to provide a method for shaving that produces continuous super-saturation of foam and lubricant contacting the user's face as the razor blades are urged thereacross.

Another object of the present invention is to provide a system wherein maximum lubricant can be applied to the face in a dried film and wherein adequate water can be provided to super-saturate the foam throughout the stroke there by providing sufficient moisture to activate the heavy film of lubricant in place. "A cushion of lubrication is, therefore, created at the blade's edge that significantly and continually reduces shaving friction."

Yet another object of the present invention is to provide a reservoir of water, adjacent to the blades, that can be controllably released by the user onto the blades and user's face adjacent thereto.

And still another object of the present invention is to provide a convenient system for shaving whereby the user can select a razor head adaptor that will provide a selected water capacity comparable to the thickness of the users beard.

In support of the previous objects, another object of the present invention is to provide a method for shaving using the above mentioned attachment for disposable razors wherein separately applied lubricant is not wicked from the user's face by the shaving foam.

These and other objects and advantages of the present invention are accomplished through the use of a rectangular dispenser having means for detachably and reattachably connecting the dispenser reservoir between a razor handle and a disposable blade carrying head such that one or more reservoir openings (i.e., flow through areas) defined in a selected face of the dispenser are adjacent to the disposable head and the razor blades carried thereby. The open side of the reservoir is in direct communication with the flow areas defined within the razor head and when the disposable head and dispenser are held beneath a flowing faucet, the water passes easily through the razor head to fill the reservoir. When the user of the present invention places the disposable head against his face to urge the blades thereacross, water in predetermined quantity flows from the reservoir through the areas of the blade head and onto the blades and user's face adjacent thereto.

The present invention does not require a pump created by the fluttering of the razor blades for pumping the water from the reservoir through the head and across the blades to the face as does Harrison Sr. That is, pumping liquid through a very small capillary size weep hole is a different concept altogether than in the present invention's concept of placing control of the surface tension effect in the hands of the shaver so that flow can be regulated. Furthermore, no build-up of vacuum in the reservoir is required to prevent the free flow of water from the reservoir to the blade. Refill of the reservoirs with hot water by merely holding the razor under a running faucet (as foam is washed off) is a new concept. The present invention is much more simplistic and a great improvement over the teachings of Harrison Sr. in that cumbersome refilling of a reservoir is eliminated and hot water is provided by the refilling process.

The method for shaving using the present invention requires applying a quick drying lubricant onto the user's face and allowing the lubricant to quickly dry into a film. This is accomplished by placing a small amount of liquid lubricant in the palm of one hand whereupon it is thinly spread by the fingers of the other hand, or by some similar natural action. The film forms almost instantly. Maximum lubrication is therefore provided in place.

After the lubricant is applied, shaving foam is applied to the film of dried lubricant for the reasons set forth above. It is very important to note that since the lubricant is already dry, the dry shaving foam cannot dilute, or wick the lubricant from the user's face. The reservoir is then filled under the running faucet with a predetermined temperature of water and is stroked across the user's face. The reservoir is refilled as the foam is rinsed from the razor. Water flowing through the separated flow-through areas of the blade head will instantly super-saturate the foam and activate the dried lubricant film. Activation of the undiluted lubricant by the supersaturated foam is continuous through the stroke. Supersaturation of the foam through-out the stroke is provided by the water from the reservoir. Thus, maximizing the lubrication of the skin to minimize abrasion thereof by the razor blades traveling thereacross.

The prior art shaver's frequent problem with "razor burn" and facial tenderness are proof of inadequate lubrication. Adequate lubrication to cause the blade to "slip" over the skin and not cut it is provided by the dried film. However, a comparatively copious amount of water is needed to supersaturate the foam adequately and thereby completely activate the lubricant and provide a degree of lubrication not yet available. This system which has been created to provide maximum lubrication, and the resulting maximum slipperiness (and thus shaving comfort) is a two-component system, and requires both components to be effective.

The amount of water which flows from the reservoir is directly proportionate to the cross-sectional area of the water compartments in the reservoir. Thus, a large rectangular compartment may be provided which accommodates a rapid discharge of the water almost simultaneously with the placement of the razor against the user's face. Smaller, rectangular compartments, precisely dimensioned, the openings of which coincide with the portals in the blade cartridge, because of their size and depth, retain water by virtue of surface tension when the razor is held level in contact with the face. At the beginning of the stroke, a slight tilt of the razor to one side causes an accumulation of water in the corner of each small rectangular compartment so that gravity breaks the surface tension, and causes water to flow out across the blade face. A tilt in the other direction during the stroke releases the remainder of water. Tilting the small and rectangular reservoirs concentrates a greater weight of the contained water against a smaller area of surface tension which ruptures it and permits the water to flow. Thus, the user is able to enjoy complete control of the water flow, which creates instant lubrication. Alternatively, rectangular portals and/or small weep holes may be provided which allow the water to seep continuously from the reservoir during the entirety of the stroke.

There has thus been outlined, rather broadly, the more important features of the invention in order that the detailed description thereof that follows may be better understood, and in order that the present contribution to the art may be better appreciated. There are, of course, additional features of the present invention that will be described hereinafter and which will form the subject matter of the claims appended hereto. In this respect, before explaining the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

Apparatus embodying features of the present invention are depicted in the accompanying drawings which form a portion of this disclosure and wherein:

FIG. 6 is a perspective view of a second embodiment of my invention;

FIG. 7 is a sectional view taken along line 7—7 of FIG. 6;

FIG. 8 is a sectional view taken along line 8—8 FIG. 6;

FIG. 9 is a perspective view of a third embodiment of my invention;

FIG. 10 is a sectional view taken along line 10—10 FIG. 9;

FIG. 11 is a sectional view taken along line 11—11 FIG. 9;

FIG. 12 is a perspective view of a fourth embodiment my invention;

FIG. 13 is a sectional view taken along line 13—13 FIG. 12;

FIG. 14 is a sectional view taken along line 14—14 FIG. 12;

DESCRIPTION OF A PREFERRED EMBODIMENT

Figure 1:
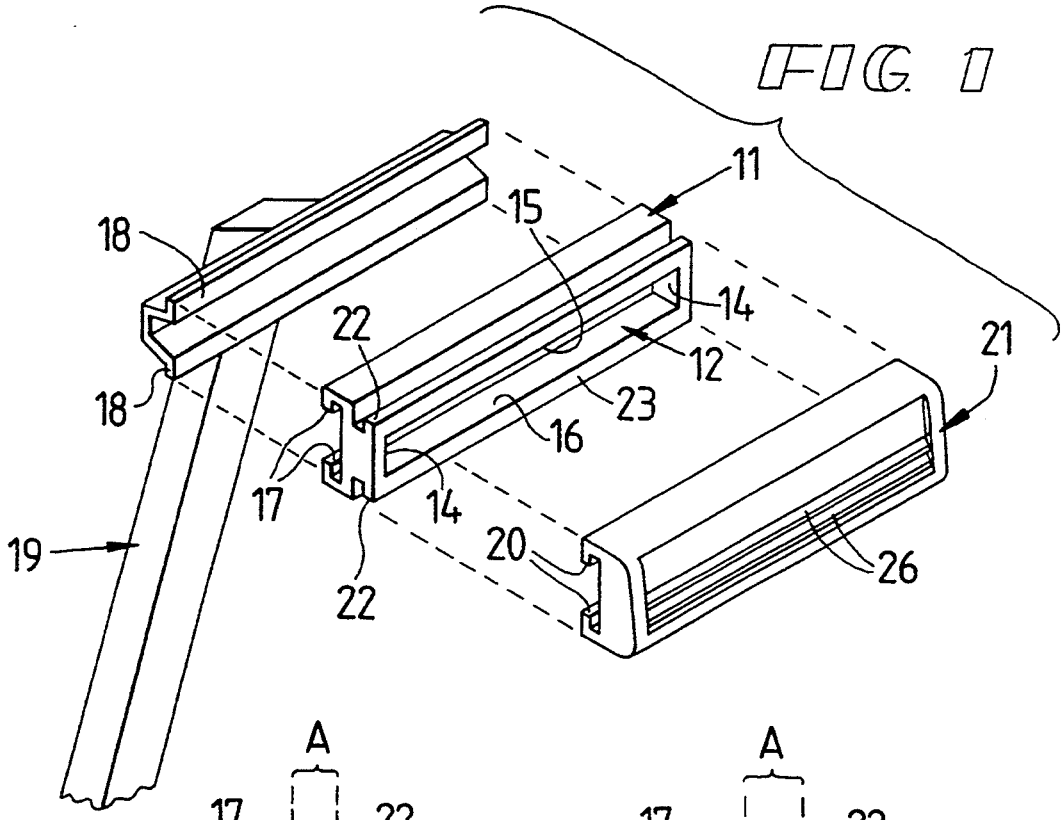
FIG. 1 is an exploded perspective view showing a razor handle, a disposable blade carrying head and my detachable reservoir.

Referring to the drawings for a clearer understanding of the invention, it should be noted in FIG. 1 that a first embodiment of the present invention contemplates the use of an elongated water dispenser 11 that defines a substantially rectangular reservoir 12 therein. The dispenser 11 has a rectangular bottom 13 with two vertically extending ends 14 integrally connected to the bottom 13 in perpendicular relation thereto, a first side 15 integrally connected to the ends 14 and bottom 13 in normal relation thereto, and a second side 16 integrally connected to the bottom 13 and ends 14 in normal relation thereto and in spaced relation to the first side 15.

Bottom 13 and sides 15 and 16 have a pair of opposing channel members 17 integrally connected thereto in longitudinal extension thereon for slidably engaging a pair of flange members 18 which form a portion of a razor handle 19. Such attachment members 18 are commonly found on many razor handles 19 and are typically engaged by channel members 20 connected to a disposable blade carrying head 21 for detachably and reattachably securing the head 21 to the handle 19. When the dispenser 11 is connected to the razor handle 19, the head 21 is connected to the dispenser 11 opposite the razor handle 19 such that the dispenser 11 is intermediate handle 19 and head 21.

The channel members 20 detachably and reattachably engage a pair of opposing flange members 22 forming a forward face 23 of dispenser 11 in longitudinal extension thereon.

It should be apparent that other methods and apparatus for connecting a blade carrying head 21 to a razor handle 19 are available and contemplated for use with the present invention to connect the dispenser 11 intermediate the handle 19 and head 21.

The dispenser 11 defines an enlarged rectangular opening 24 which is connected to and in communication with the reservoir 12. The opening 24 extends longitudinally on the dispenser 11 adjacent to head 21 and one or more flow through areas in the head 21 that lead to the blades 26 carried thereby.

In operation, the present invention is used in conjunction with a lubricant 31 and shaving foam or gel 27. The method described herein for using the naturally quite dry foam 27 and lubricant 31 is necessary to insure optimum efficiency of the aforedescribed razor and reservoir combination. Prior to shaving, the lubricant 31 is applied to the user's dry face 28 and allowed to quickly dry into a film 29. After the lubricant 31 has dried, shaving foam 27 is applied to the film 29. Allowing the lubricant 31 to dry before applying the shaving foam 27 prevents the shaving foam 27, which must be comparatively dry in order to hold its shape, from wicking the lubricant 31 from the user's face 28.

After the shaving foam 27 is applied, the head 21 and dispenser 11 may be held beneath a running faucet (not shown) wherein the reservoir 12 is filled through opening 24. The head 21 is placed against the user's face 28 and the razor handle 19 and dispenser 12 are tilted such that water in the reservoir 12 flows therefrom and onto blades 26.

Figure 3:
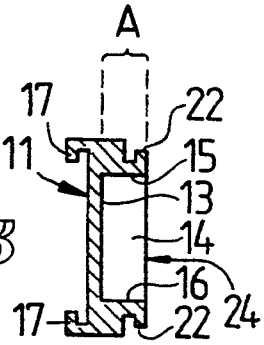
FIG. 3 is a sectional view of the reservoir configured to contain a minimum volume of water.
Figure 4:
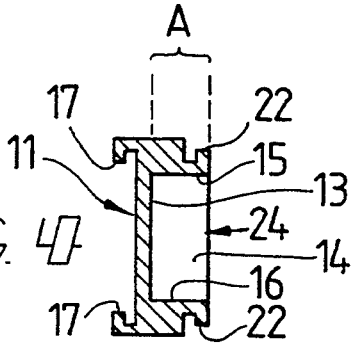
FIG. 4 is a sectional view of the reservoir configured to contain a moderate volume of water.
Figure 5:
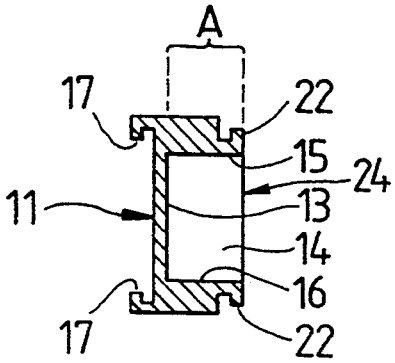
FIG. 5 is a sectional view of the reservoir configured to contain a maximum volume of water.
Figure 2:
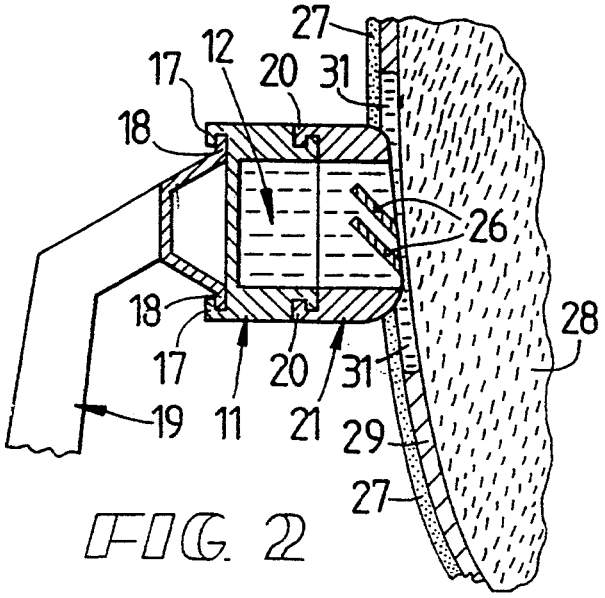
FIG. 2 is a sectional view showing the handle, reservoir and blade carrying head in use.

As is shown in FIG. 2, the water moves from the blades 26 and onto the user's face 28 adjacent the blades 26 to saturate the foam 27 and rehydrate the film 29 of lubricant 31 proximal thereto. The razor head 21 and blades 26 are urged across the rehydrated lubricant 31 which prevents abrasion of the user's face 28. Since the lubricant 31 is hydrated just before the razor head 21 and blades 26 pass thereover, the comparatively dry shaving foam 27 is unable to wick the lubricant 31 from the user's face 28 before the passage of the head 21 and blades 26 thereover. Moreover, water flowing from the reservoir 12 super-saturates the foam 27 as the stroke progresses which, in turn, continuously activates the film 29 of lubricant 31. Super-saturated foam 27 cannot be applied directly to the user's face 28. It will run off. Unless the foam 27 is saturated, it will not properly activate the lubricating film 29. All three ingredients are essential. The large rectangular opening 24 of the first embodiment facilitates a rapid discharge of the water from the reservoir 12 such that a predominant portion of the water is discharged at the beginning of the stroke. A user may prefer a particular volume of water discharged at the beginning of the stroke and, accordingly, the depth of the reservoir 12 (indicated as A) may vary from shallow to deep as shown in FIGS. 3–5, respectively.

A second embodiment of the invention is shown in FIGS. 6–8, wherein the reservoir 12 is divided by one or more interior walls 32 into a plurality of compartments 33. The interior walls 32 extend normal to the longitudinal extension of the reservoir 12 and in coplanar relation to associated parallel divider walls 34, FIG. 7, which are typically formed in the blade carrying head 21 for supporting blades 26. The interior walls 32, FIG. 6, in cooperation with the associated divider walls 34, provide separate conduits 35 along which water may travel from the reservoir 12 to specific portions of the blades 26. Such separate conduits 35 insure that the water is dispersed evenly across the blades 26. Also, the rectangular shape and size of the compartments 33 are designed to react with water surface tension to restrain water, when held level, and to spill the water into the conduits 35 when the reservoir 12 is tilted.

A third embodiment of the present invention is shown in FIGS. 9–11 and, in addition to the interior walls 32, has a plurality of lower baffles 36 integrally connected to the interior walls 32 for reducing the flow of water from the reservoir 12. The lower baffles 36 extend adjacent to the second side 16 to partially define the forward face 23. The lower baffles 36 and walls 32 define a plurality of primary portals 37 through which water is dispersed from the reservoir 12. Weep holes 38 are defined by the lower baffles 36 to provide additional controlled flow.

By reducing the initial flow of water from the reservoir 12, the dispenser 11 will provide a continuous stream of water during the entirety of a razor stroke. Initially, water will flow rapidly through the primary openings 37. This rapid initial flow is necessary to quickly convey some of the water from the reservoir 12 to the foam 27 and lubricant film 29 prior to or simultaneous to the urging of the blade head 21 across the user's face 28. A predominate portion of the water, however, will flow through the weep holes 38 even though the weep holes 38 provide only a minimal flow area relative to the primary opening 37. During the latter portion of the stroke, when the water level has fallen below an upper margin **36*a* of the baffle 36, water will flow exclusively through the weep holes 38 due to the placement of the weep holes 38 proximal to the lower portion of the reservoir 12. Thus, a continuous stream of water will flow through the weep holes 38, onto the lubricant 29 and user's face 28 during the entirety of the stroke. Thus, two required conditions are met. First, an immediate quantity of water which super-saturates the foam Z7 and activates the film 29** of lubricants and, second, provides saturation through the stroke.

A fourth embodiment of the present invention is shown in FIGS. 12–14 and includes the interior walls 32 previously described and a plurality of vertical baffles 39 integrally connected to the interior walls 32 for restricting the flow of water from the reservoir 12. The vertical baffles 39 define a plurality of vertical flow ports 41 which extend between sides 15 and 16 of the dispenser 11. The fourth embodiment provides a positive retainment of water when the dispenser 11 is tilted in one direction, releasing only the water held behind an elevated baffle **39*a* in the compartment. When the razor is tilted in the opposite direction, the remaining water, previously contained by the opposite baffle 39*b*, is released. This design enhances the control which the user exercises over the discharge of water during the shaving stroke. The second, third and fourth embodiments are available in variable volume capacities, as represented in FIGS. 3, 4 and 5**.

Figure 15:
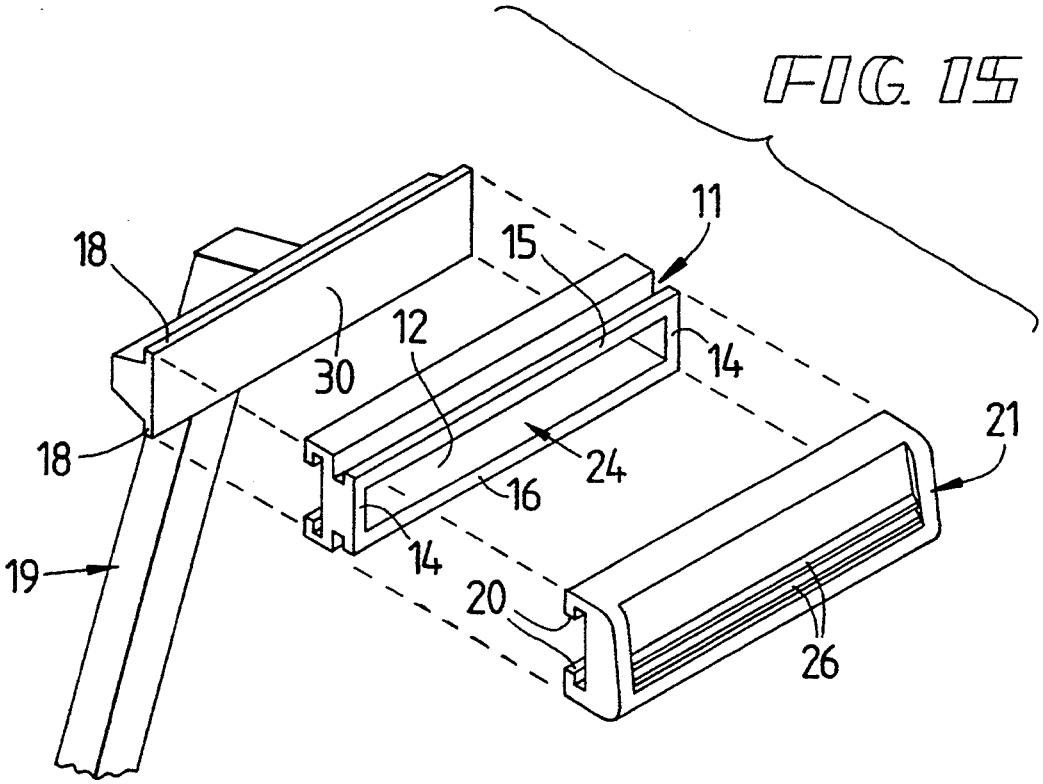
FIG. 15 is an exploded perspective view of a fifth embodiment of my invention.
Figure 16:
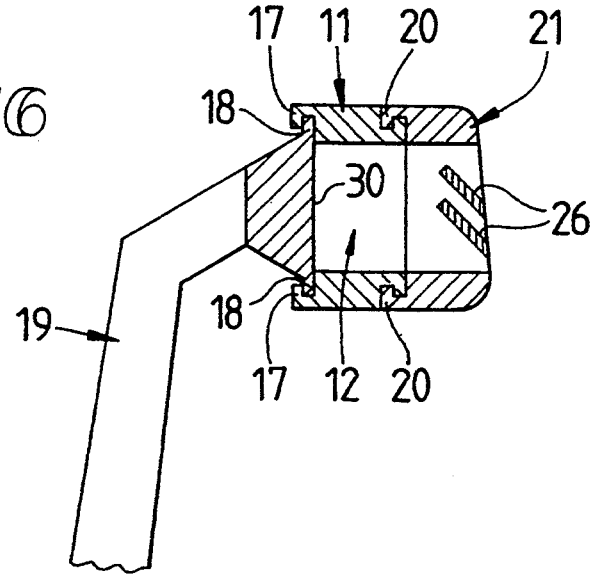
FIG. 16 is a sectional view taken along line 16—16 FIG. 15.

A fifth embodiment of the present invention is shown in FIGS. 15 and 16, whereby the handle 19 has a planar face 30. The planar face 30 replaces bottom 13 which has been eliminated from dispenser 11 to facilitate easier manufacture thereof. It should be apparent that the present invention also contemplates the razor handle 18, dispenser 11 and head 21 being integrally connected and disposable as a single unit.

While I have shown my invention in several forms, it will be obvious to those skilled in the art that it is not so limited but is susceptible of various changes and modifications without departing from the spirit thereof.

What I claim is:

1. An article to be used with disposable shaving razors having a handle, a disposable blade carrying head and means for detachably and reattachably connecting said blade carrying head to said handle, for supplying a controllable quantity of water adjacent to one or more blades fixedly carried by said head, said article comprising:

(a) an elongated dispenser defining an elongated fixed rectangular reservoir therein and one or more openings through a selected face thereof, wherein said one or more fixed openings are integral with said reservoir such that said reservoir may be interactively filled with a quantity of water by placing said reservoir under a water faucet, whereupon said water passes through said fixed openings to fill said reservoir and is retained therein solely by surface tension of said water, and without any mechanical vacuum or other mechanical water retention system, until said reservoir is tilted to a selected angle when said one or more fixed blades are urged across user's face to allow said quantity of water to flow through said openings from said reservoir onto said blades and said face;

(b) first means connected to said dispenser for detachably and re-attachably connecting said dispenser to said handle; and (c) second means connected to said dispenser adjacently to said selected face for detachably and re-attachably connecting said dispenser to said fixed blade carrying head, such that said selected face having said one or more openings therethrough is positioned adjacent to said blade carrying head.

2. An article as defined in claim 1 further comprising a plurality of lower baffles integrally connected to said internal walls and partially forming said selected face adjacent said blade carrying head for reducing the flow rate of said quantity of water from said reservoir and through said openings.

3. An article as defined in claim 2 wherein said one or more openings comprise a plurality of rectangular primary flow ports partially defined by said internal walls and above said lower baffles.

4. An article as defined in claim 3 wherein each said lower baffle defines one or more weep holes through which said quantity of water may flow at a regulated rate, wherein said quantity of water will flow predominantly through said plurality of primary flow ports until said quantity of water within said reservoir is below an upper margin of said lower baffle, whereafter said water will flow predominantly through said weep holes at said regulated rate.

5. An article as defined in claim 2 wherein each said lower baffle defines one or more weep holes through which said quantity of water may flow at a regulated rate.

6. An article as defined in claim 1 further comprising a plurality of vertical baffles connected to said internal walls and to said dispenser and partially forming said selected face, wherein said plurality of vertical baffles partially restrict the flow of said quantity of water from said reservoir and through said openings.

7. An article as defined in claim 6 wherein said one or more openings comprises a plurality of rectangular vertical flow ports partially defined by said vertical baffles and extending flush with spaced first and second sides of said reservoir.

8. An article as defined in claim 1 further comprising one or more internal walls connected to said first and second sides and to said bottom in parallel planar relation to said ends and in corresponding coplanar relation to a plurality of divider walls integrally connected to said blade carrying head, wherein said internal walls, and said corresponding divider walls restrict the lateral movement of said quantity of water as said quantity of water flows from said reservoir and onto said one or more razor blades such that said quantity of water is evenly distributed across said blades.

9. An article as defined in claim 8 further comprising a plurality of baffle plates integrally connected to said internal walls for controlling the flow of said quantity of water from said reservoir.

10. An article to be used with disposable shaving razors having a handle, a disposable blade carrying head and means for detachably and reattachably connecting said blade carrying head to said handle, for supplying a controllable quantity of water adjacent to one or more blades fixedly carried by said head, said article comprising:

(a) an elongated dispenser defining a plurality of reservoirs therein each defined by internal transverse walls, each reservoir having fixed openings through a selected face of said dispenser, wherein said fixed openings are integral with each reservoir such that said reservoirs may be interactively filled with a quantity of water by placing said reservoirs under a water faucet, whereupon said water passes through said fixed openings to fill said integral reservoirs and is retained within said reservoirs solely by surface tension of said water, and without any mechanical vacuum or other mechanical water retention system, until said reservoirs are tilted to a selected angle when said one or more fixed blades are urged across user's face to allow said quantity of water to flow through said openings from said reservoirs onto said blades and said face;

(b) first means connected to said dispenser for detachably and re-attachably connecting said dispenser to said handle; and (c) second means connected to said dispenser adjacently to said selected face for detachably and re-attachably connecting said dispenser to said fixed blade carrying head, such that said selected face having said openings therethrough is positioned adjacent to said blade carrying head.

11. An article as defined in claim 10 further comprising a plurality of lower baffles integrally connected to said internal walls and partially forming said selected face adjacent said blade carrying head for reducing the flow rate of said quantity of water from said reservoir and through said openings.

12. An article as defined in claim 10 further comprising a plurality of vertical baffles connected to said internal walls and to said dispenser and partially forming said selected face, wherein said plurality of vertical baffles partially restrict the flow of said quantity of water from said reservoir and through said openings.

* * * * *